United States Patent [19]

Strausser

[11] 4,312,134

[45] Jan. 26, 1982

[54] METHOD OF FREEZE-DRYING FLOWER ARRANGEMENTS

[76] Inventor: Robert W. Strausser, 6110 Newton Falls Rd., Ravenna, Ohio 44266

[21] Appl. No.: 174,842

[22] Filed: Aug. 4, 1980

[51] Int. Cl.[3] ..... F26B 5/06; F26B 5/10; F26B 5/04

[52] U.S. Cl. ..... 34/5; 34/9; 34/15

[58] Field of Search ..... 34/5, 9, 15; 62/100, 62/268

[56] References Cited

U.S. PATENT DOCUMENTS

| | | | |
|---|---|---|---|
| 2,906,636 | 9/1959 | Hoivik | 34/9 |
| 3,286,365 | 11/1966 | Hackenberg | 34/5 |
| 3,835,550 | 9/1974 | Kaneko | 34/5 |

*Primary Examiner*—John J. Camby

*Attorney, Agent, or Firm*—Oldham, Oldham, Hudak & Weber Co.

[57] ABSTRACT

A method for freeze-drying flower arrangements whereby freshly cut flowers and foliage may be arranged and placed into a glass container with the arrangement subsequently dehydrated by a freeze-drying process. This process rapidly sets the arrangement such that wilting and distortion are minimized. Any color loss in the arrangement from the dehydration process is restored by spray tinting techniques. After the dehydration and tinting process, the container is sealed for protection from the ambiance. The method of the invention allows a floral arrangement to be dried as a whole, eliminating the delicate operation experienced when pre-dried flowers and foliage are used in assembling the dried arrangement.

12 Claims, No Drawings

METHOD OF FREEZE-DRYING FLOWER ARRANGEMENTS

BACKGROUND ART

This invention resides in the art of arranging and preserving flowers and foliage. Particularly, there is presented a method whereby freshly cut vegetation may be arranged and, subsequently, dried and preserved by a freezing process. The invention achieves a substantial reduction in the time required in creating a dried arrangement which maintains a life-like appearance as to both color and texture for a substantial period of time.

For centuries, people have found it desirous to have flower arrangements about them for brightening their homes, offices, and the like. Arrangements made from freshly cut flowers and foliage, however, have a tendency to fade and wilt in a short period of time, necessitating frequent replacement. Dried arrangements have become popular since they have a useful life significantly beyond that of freshly cut arrangements. However, dried arrangements are generally limited to specific types of flowers and foliage, limiting the nature of the arrangements possible, and they are generally of subdued hues, as compared to fresh arrangements. To add color to long-lasting floral arrangements, silk and other artificial flowers have been introduced which bear an improved resemblance to live flowers over prior art facsimiles. However, even the present day silk flowers are easily discerned and, equally important, are quite expensive.

A number of approaches have been taken in the prior art to dry and preserve vegetation to achieve long-lasting flower arrangements from fresh-cut foliage. Indeed, the prior art has taught dehydration of individual flowers or other pieces of vegetation with the dried pieces being subsequently arranged as desired. However, it has been found that all of the techniques known in the art for dehydrating or drying the fresh flowers results in a dried flower or foliage piece which is brittle and fragile, making the arrangement process difficult and time-consuming. Special precautions must be taken in handling so that the dried pieces do not break during the arranging process and in subsequent movements.

Known methods of drying flowers have included the utilization of pressing, subjection to hot dehumidified air, and immersion into drying agents such as silica sand, acids, alkalines, salts, alcohol, and the like. Indeed, a number of patents have issued on apparatus and techniques for drying freshly cut flowers for use in a dried arrangement. Attention is directed to the following U.S. patents, none of which teach the approach or technique of applicant's invention: U.S. Pat. Nos. 3,577,647; 3,593,429; 3,835,550; 2,906,636; 3,571,942; 3,979,837; and 3,604,123.

None of the known prior art techniques for achieving a dried arrangement allow one to construct the arrangement from freshly cut flowers and foliage and then subsequently dry the arrangement by a freeze-drying process. Indeed, the state of the art appears to be the time-consuming and expensive process of drying individual pieces by immersion and, subsequently, constructing a dried arrangement from the previously dried pieces.

DISCLOSURE OF INVENTION

In light of the foregoing, it is an object of the instant invention to present a method of freeze-drying flower arrangements wherein flower arrangements may be made using freshly cut flowers with the resultant arrangement being dried as a whole.

Another object of the invention is to present a method of freeze-drying flower arrangements wherein the flowers of the arrangement retain their color for long periods of time following the drying process.

Yet a further object of the invention is to present a method of freeze-drying flower arrangements wherein the flowers and foliage of the arrangement, being dehydrated by a freeze-drying process, retain their natural texture for extended periods of time.

Yet an additional object of the invention is to provide a method of freeze-drying flower arrangements which requires no immersion of the arrangement or individual pieces in a drying solution.

Still a further object of the invention is to present a method of freeze-drying flower arrangements which may be accomplished quickly, efficiently, and inexpensively with respect to state-of-the-art processes.

The foregoing and other objects of the invention which will become apparent as the detailed description proceeds are achieved by the process of freeze-drying floral arrangements, comprising the steps of: arranging freshly cut vegetation in an open container and placing said container in a chamber having a temperature and pressure substantially reduced from the ambiance; gradually increasing the temperature within said chamber to a terminal point; and sealing said open container with a lid.

BEST MODE FOR CARRYING OUT THE INVENTION

The principal concept of the instant invention is to construct a floral arrangement using freshly cut flowers and foliage, and then to subject such arrangement to sub-freezing temperatures in a vacuum chamber for a period of time sufficient to dry the flowers and foliage in a freeze-drying operation. Typically, the drying technique requires a period of time, of approximately one week, with the temperatures being varied during that period, between −80° F. and 40° F.

The flower arrangement is preferably assembled and then placed into a clear glass container by placing the floral pieces into a styrofoam base in the bottom of the container, in a somewhat standard fashion. Depending upon the size of the opening of the glass container, the actual assembling and placement of the arrangement in the container may require the use of special care and dexterity. However, since the arrangement is made with freshly cut pieces, the flexibility and resiliency of the elements composing the arrangement substantially eliminate the risk of damage or breakage of the pieces. This is in contradistinction with what is generally experienced when assembling such an arrangement with pre-dried floral pieces.

Either prior, or subsequent, to the placement of the floral arrangement in the glass container, a small amount of silica sand is placed in the bottom of the container for purposes of absorbing any residual moisture which might remain in the container or the floral arrangement following the freeze-drying process. For a typical round glass vase or container, ten inches in height, and having a six-inch diameter, approximately one-third gram of silica sand has been found to be sufficient for such residual drying.

With the container maintaining the floral arrangement and a small portion of silica sand, it is placed into a suitable freeze-dryer of the type manufactured by VirTis Co., Inc., of Gardiner, N.Y., and described in "ANNEX 1 to Catalog Sections 'A' and 'B'," copyrighted in January, 1969. Initially, the freeze-dryer is set to maintain a chamber temperature in the range of −80° F. to −40° F. and preferably on the order of approximately −60° F. Such temperature is maintained for approximately 8 hours. This initial extremely cold setting is used to quickly set the arrangement, such that the water molecular structure in the foliage is rapidly frozen and the arrangement, from that time forward, retains the desired arranged appearance. After the first 8 hours in the freeze-drying chamber, the temperature is raised to the range of −30° F. to −20° F. and is maintained at that temperature for approximately 3–4 days. Subsequently, for the next 2–3 days, the temperature is maintained in the range of −20° F. to 0° F. A final period of approximately one day is provided with the temperature set on the order of 40° F.

The temperature regulation is important for achieving optimum results. Each flower or type of vegetation has a characteristic dehydration point. If the temperature is raised above that at which dehydration will be maintained before the flower is dehydrated, the flower may start to thaw and distort. After the flower has been dehydrated, the temperature can be raised because there is no moisture left within the flower to cause distortion. Hence, the temperature is initially set low and gradually increased.

In the first temperature range of −30° F. to −20° F., it has been found that daffodils, narcissus, roses, African violets, carnations, and certain ferns are most efficiently dried. Similarly, in the range of −20° F. to 0° F., impatiens, fungi, calceolaria, black-eyed Susans, and certain other ferms are most efficiently dried. In both ranges, it has been found that asparagus, statice, and baby's breath dehydrate well. By following the schedule of temperatures and times set forth above, each of the above types of vegetation comprising an arrangement has been found to dehydrate well.

During the freeze-drying process described above, a vacuum pump is operated in the freeze-drying chamber to evacuate the chamber and to draw moisture from the arrangement and container. Extraction of the moisture is by sublimation, by which the frozen water molecules within the floral pieces are vaporized and collected on a colder surface in the freeze-drying chamber without actually passing through the liquid stage. Consequently, there is no wilting or deformation of the flowers and foliage, and color loss is minimized, although dehydration naturally tends to effect the light-transmissive and reflective qualities of the components of the arrangements. In the preferred process, the pressure within the freeze-drying chamber is reduced to under 100 microns during the freeze-drying process, but other suitable pressure reduction could be incorporated, as would become apparent to those skilled in the art.

It will also be appreciated that the freeze-drying process also dehydrates the silica sand in the bottom of the container, such that the sand is available for absorbing any moisture which might collect in the container or on the arrangement, upon removal from the chamber prior to placement of a sealing cap over the container. This cap is again preferably of clear glass construction and may be sealed by appropriate means, such as epoxy or plastic shrink fittings. In any event, sealing of the bottle prevents oxidation of the flower color and keeps the flowers from acquiring ambient moisture. It is not necessary that the container itself be evacuated since the silica sand is available for absorbing any moisture which might enter the container prior to the sealing operation.

It has been found that certain flowers retain their color well despite the fact they have been freeze-dried. Apparently, such flowers retain their color due to the tissue composition of the petals, leaves, and the like. Carnations, African violets, roses, asparagus and other ferns, and baby's breath exhibit good color retention notwithstanding the dehydration during the freeze-drying process. Those floral pieces which either dull or fade from dehydration may be given color by utilization of a florist's spray tint. This spray coloring restores the lost color which, in the sealed environment of the glass container of the final product, retains its given color along with the natural color of the other pieces.

Thus, it can be seen that the objects of the invention have been satisfied by the techniques and methods presented hereinabove. Fresh floral arrangements may be quickly assembled without fear of damage or breakage and then be dehydrated by a freeze-drying process in a container which is subsequently sealed. Any color which is lost in the freeze-drying process may be restored by spray tinting. The result is a dried arrangement characterized by brilliant, natural colors which, in the sealed container, will last for significantly long periods of time.

While in accordance with the patent statues only the best mode and preferred embodiment of the invention has been presented and described in detail, it is to be understood that the invention is not limited thereto or thereby. Accordingly, for an appreciation of the true scope and breadth of the invention, reference should be had to the appended claims.

What is claimed is:

1. The process of freeze-drying floral arrangements, comprising the steps of:

arranging freshly cut vegetation in an open container and placing said container in a chamber having a temperature and pressure substantially reduced from the ambiance;

gradually increasing the temperature within said chamber to a terminal point; and sealing said open container with a lid.

2. The process according to claim 1 which further includes the step of maintaining a low pressure within said chamber by continuous operation of a vacuum pump.

3. The process according to claim 2 wherein said vacuum pump is operated to maintain said pressure within said chamber below 100 microns.

4. The process according to claim 1 wherein the step of gradually increasing said temperature of said chamber is achieved incrementally, said temperature being maintained at progressively increased temperatures for fixed time durations.

5. The process according to claim 4 wherein the temperature of said chamber is initially set at approximately −60° F. for a first time period.

6. The process according to claim 5 wherein said temperature of said chamber is next set in the range of −30° F. to −20° F. for a second time period.

7. The process according to claim 6 wherein said temperature of said chamber is next set in the range of −20° F. to 0° F. for a third time period.

8. The process according to claim 7 wherein said temperature of said chamber is lastly set at approximately 40° F. for a fourth time period.

9. The process according to claim 8 wherein the aggregate of said first through fourth time periods comprises between 6 and 8 days.

10. The process according to claim 9 wherein the pressure within said chamber is maintained during said time periods at less than 100 microns.

11. The process according to claim 4 which further includes the step of depositing a dehydrating media within said container.

12. The process according to claim 11 which further includes the step of spray tinting certain of the vegetation after said fourth time period and prior to said sealing step.

* * * * *